US007717785B2

(12) United States Patent
Odom

(10) Patent No.: US 7,717,785 B2
(45) Date of Patent: May 18, 2010

(54) ELECTRONIC BINGO GAME AND METHOD

(75) Inventor: Wayne Odom, Tucson, AZ (US)

(73) Assignee: Karaway Gaming, Inc., Tucson, AZ (US)

( * ) Notice: Subject to any disclaimer, the term of this patent is extended or adjusted under 35 U.S.C. 154(b) by 393 days.

(21) Appl. No.: 11/282,891

(22) Filed: Nov. 18, 2005

(65) Prior Publication Data

US 2006/0121977 A1 Jun. 8, 2006

Related U.S. Application Data

(63) Continuation-in-part of application No. 10/443,567, filed on May 22, 2003, now Pat. No. 7,316,612, which is a continuation-in-part of application No. 09/557,948, filed on Apr. 24, 2000, now Pat. No. 6,581,935.

(51) Int. Cl.
*A63F 1/18* (2006.01)
*A63F 9/24* (2006.01)

(52) U.S. Cl. ..... 463/19; 463/16; 273/138.1; 273/138.2; 273/269; 273/296

(58) Field of Classification Search ..... 463/11–13, 463/16, 17–20, 25–27, 29; 273/138.2, 269, 273/274, 138.1, 141 A, 142 B, 142 C, 142 J, 273/296; *A63F 1/18, 9/00, 9/24*
See application file for complete search history.

(56) References Cited

U.S. PATENT DOCUMENTS 5,297,802 A * 3/1994 Pocock et al. ..... 463/19
5,577,727 A * 11/1996 Brame et al. ..... 273/139
5,624,119 A * 4/1997 Leake ..... 273/269
5,647,798 A * 7/1997 Falciglia ..... 463/19
5,727,786 A * 3/1998 Weingardt ..... 273/269
5,951,396 A * 9/1999 Tawil ..... 463/19
6,159,095 A * 12/2000 Frohm et al. ..... 463/19
6,183,361 B1 * 2/2001 Cummings et al. ..... 463/18
6,398,645 B1 * 6/2002 Yoseloff ..... 463/19
6,569,017 B2 * 5/2003 Enzminger et al. ..... 463/19
6,656,044 B1 * 12/2003 Lewis ..... 463/19
6,755,738 B2 * 6/2004 Glasson et al. ..... 463/19
2002/0132661 A1 * 9/2002 Lind et al. ..... 463/19
2003/0144050 A1 * 7/2003 Keaton et al. ..... 463/19
2004/0048647 A1 * 3/2004 Lind et al. ..... 463/19
2004/0077399 A1 * 4/2004 Marshall ..... 463/19

* cited by examiner

*Primary Examiner*—Peter DungBa Vo
*Assistant Examiner*—Arthur O. Hall
(74) *Attorney, Agent, or Firm*—Robert Ryan Morishita; Morishita Law Firm, LLC

(57) ABSTRACT

A Bingo game and method are set forth wherein a player inputs a wager and at least one Bingo card is generated. A first outcome set is selected and compared to the indicia on the Bingo card. If a predetermined winning pattern(s) is obtained, the player receives a first reward. A second outcome set is selected. If the player obtains a predetermined winning pattern(s) on the Bingo card from the combination of the first and second outcome sets, the player receives a second award. Optionally, the player may select the numbers for his Bingo card or may regenerate his Bingo card at the beginning of a game. In an optional embodiment, the player may place a second wager prior to selection of the second outcome set. In an optional Class II version of the game, the player competes with a plurality of live player or virtual Bingo cards.

37 Claims, 2 Drawing Sheets

ELECTRONIC BINGO GAME AND METHOD

RELATED APPLICATION DATA

This application is a continuation-in-part of U.S. patent application Ser. No. 10/443,567, now U.S. Pat. No. 7,316,612, entitled "Electronic Bingo Game and Method," filed May 22, 2003 by Applicant herein, which, in turn, was a continuation-in-part of U.S. patent application Ser. No. 09/557,948, now U.S. Pat. No. 6,581,935, entitled "Electronic Bingo Game and Method," filed Apr. 24, 2000 by Applicant herein. This application also claims priority to PCT Application No. PCT/US03/15670 with a priority date of May 19, 2003 filed by Applicant herein.

FIELD OF THE INVENTION

The present invention relates to games playing on an electronic device having a display. More particularly it relates to electronic Bingo games and methods.

BACKGROUND

Bingo is a well known game. In its live, non-electronic, form, each player purchases a Bingo card which presents a column/row, five-by-five, matrix. Each column is identified by a letter; B-I-N-G-O and at each coordinate location in the matrix a number is provided. Often the center coordinate location is marked "Free" rather than having an assigned number. After each player or participant has purchased a card, means are provided to randomly select numbers identified by the column letter and a number, e.g. B15. If a player has, in column B number 15, that coordinate location is marked. Typically the universe of letters/numbers is provided on balls which are mixed and serially drawn from a cage or mixer. The selection of balls continues until a player has a card marked (corresponding numbers have been drawn) in a winning pattern. This pattern might be designated before the game as a row, column, four corners, an X-pattern, or a cover all (all the numbers on the winning card being marked.) Thus, to play the game a number of players are required to provide a number of Bingo cards with different numbers so that a single winners (or a small number of winners) can be declared.

For traditional Bingo, the requirement of having a number of players, perhaps hundreds of players, has frustrated attempts to configure Bingo as a video game which can be played by a single player. Further, Bingo prizes are often fixed, regardless of the number of players, thus failing to provide large and/or progressive jackpots to the winners.

Live Bingo has heretofore been played in, what are known in gaming jurisdictions as, a Class II game. In a Class II game, the awards are typically parimutuel, i.e. paid from the fund created by the aggregated wagers for the game (less an amount permitted to be deducted for hosting the Bingo game) and each game must produce a winning card having a Bingo. That is, balls are drawn until a player who purchased a Bingo card has a Bingo. A Bingo, before the game is started, may be defined as a horizontal row, a vertical column, a diagonal, four corners, a cover all, or another designated pattern. Large progressive prizes funded by deducting an amount from each game's parimutuel fund, can be offered for a player obtaining a Bingo in a certain, predetermined, minimum number of balls.

Since Bingo is a popular and well-known game, there is a need for an electronic game and method which permits a single player to play Bingo and which is configured to provide large and progressive jackpots.

There is also a need to provide an electronic Bingo game which can be played by a single player but which also qualifies as a Class II game.

Further there is a need for device and method which provides the player with a plurality of chances to win.

Further there is a need for a device and method which provides for the player to optionally double their wager during play in regards to the additional chances to win.

With respect to electronic games using a random number generator to select an outcome, these generators typically operate off of an internal clock to randomly select a number or groups of numbers to represent an outcome. If the clock is at the same time interval with respect to the random string of numbers, the same outcome will be selected. At least some persons who play-gaming machines are aware of the operation of random number generators and, from time to time, would like to change the internal clock so that the random number generator (RNG) output is altered. Heretofore there has been no means for a player of a game to alter the internal clock time to affect the output of the RNG, and hence the values selected.

Still further there is a need for a device and method which permits the player to wager a desired amount between a pre-selected maximum and minimum amount for each game.

Still further there is a need for a device and method for playing Bingo which permits the player to select their numbers for the Bingo card.

Still further in relation to this game and other electronic games, these is a need to provide means for a player to change the RNG clock to randomly select at a different position in the random string of numbers.

SUMMARY

There is, therefore, set forth according to the present invention, an electronic device and a method for playing a Bingo game which includes a data processor and a video display. Means are provided for a player to initiate play of a Bingo game such as by the player inputting a wager and prompting play. When the game is played, one or more Bingo cards is defined. Optionally, the Bingo cards are 5×5 matrices with a discrete indicium selected from a universe of indicia at each of the twenty-five coordinate locations of each card. Optionally, the matrix is represented as a well known Bingo card having the columns identified by the letters B-I-N-G-O and the indicia being numbers. Further, the center coordinate location of each card may be noted as "Free," and the coordinate location considered as automatically selected in any pattern that includes the free space. In one optional embodiment, the player plays one Bingo card; in another optional embodiment, the player plays multiple Bingo cards. In an embodiment in which multiple Bingo cards are provided, the player may add or subtract Bingo cards singly or in discrete sets, e.g. in ten card sets, within certain minimum and maximum quantities.

First and second sets of winning patterns of identified coordinate locations on the cards are defined. Optionally, these patterns are known BINGO patterns such as a column, row, diagonal or four corners and a cover all. Also, corresponding first and second pay tables are defined to determine the award should the player obtain a winning pattern.

The processor includes a random number generator to select, from the universe of indicia, a predetermined quantity of indicia for a first outcome set, and an additional predetermined quantity of indicia defining a second outcome set. In one optional embodiment, the first set contains twenty-five selected numbers and the second set contains thirty-one selected numbers for a total of fifty-six numbers.

As indicia are selected, the processor compares each selected indicium to the Bingo card to determine if there is match or a concordance. If so, the location of the concordance is noted. Additionally, matches may be displayed much the same as marking a BINGO card. If the set of locations marked upon one or more of the cards after selection of the first outcome set matches a pattern of locations that is a winning patterns according to the first set of winning patterns, the player receives an award according to a prespecified first pay table.

A second outcome set is likewise selected and any matches with the Bingo card are noted. Optionally, the matches are displayed and, in a further optional embodiment, displayed in a different manner (color, shape, or the like) than matches from the first outcome set.

After selection of both first and second outcome sets, if the matches from the combination of the first and second outcome sets corresponds to a winning pattern according to the second set of winning patterns, the player receives an award according to a prespecified second pay table. Thus, the player may win an award based upon obtaining one or more winning patterns from the first outcome set and a separate award based upon selection of the first and second outcome sets. For example, if the second set of winning combinations includes a cover all pattern, i.e. a pattern where every coordinate of the Bingo card matches an indicium from the combined first outcome set and second outcome set, the player could be issued an award based on both the first pay table and the second pay table, assuming that certain of the matches formed a winning pattern from the first set of winning patterns after selecting the first outcome set.

Optionally, the player may be provided an opportunity to place a second wager prior to selection of the second outcome set. If the combination of the Bingo indicia selected in the first and second outcome sets result in one of a predetermined set of winning patterns on one or more cards, the player receives an award based upon the aggregate first and second wagers.

In an optional embodiment, the outcome sets are randomly selected based on a selected seed. In such an optional embodiment, the player may be allowed to opt to re-select the seed prior to selection of an outcome set. It is noted that this feature is not necessarily limited to a game in which two outcome sets are selected, as described above. Specifically, in a game in which one or more outcome sets are selected, the player may be allowed to opt to reselect the seed for the randomly selected outcome set or sets.

Additionally or alternatively, the player may also be allowed to (a) opt to, regenerate a Bingo card and/or (b) opt to retain a Bingo card from a preceding game prior to selection of a first outcome set. In an optional embodiment, the default may be a retention of the same Bingo card from a preceding game, but the player may prompt selection of a different Bingo card, i.e. regenerate the indicia displayed on the Bingo card being played. In an optional embodiment, the player may also be allowed to select indicia for placement in the player's Bingo card. It is noted that these features, opting to regenerate a Bingo card prior to commencement of a game and selecting the indicia for inclusion on the player's Bingo card, may be applied to any Bingo game in which one or more outcome sets are selected.

In a further optional embodiment, the player may compete against one or more "virtual" players. In such an optional embodiment, there may be provided a number of virtual Bingo cards in addition to the player cards. Following selection of the first outcome set and comparison with player and virtual cards, the player is rewarded if the player has one or more predetermined Bingo patterns on his card. The processor then selects the second outcome set and notes any matches on both virtual and player Bingo cards. If a player Bingo card has a predetermined pattern as a result of the second selection set, the player receives an award. If a player Bingo card does not have any predetermined pattern but a virtual card does, the processor displays the virtual card for the player to see, all wagers are collected, and the game is concluded.

Optionally, if neither player nor casino has a card with a predetermined pattern marked, either all outstanding wagers, or wagers placed after the selection of the first set of numbers may be returned to the player, i.e. "pushed." Alternately, additional numbers may be selected beyond the second set of numbers, until a card has a predetermined pattern marked. If this pattern is marked upon a player card, the player will receive a reward according to a prespecified pay table, while if this pattern is marked upon a casino card, all outstanding wagers are collected and the game is concluded. Optionally, if the same number selection completes marking of a predesignated pattern upon both a player card and a casino card, a push may result.

According to the foregoing embodiment the player may be afforded the opportunity to make the second wager.

It should be understood that while a processor can be used to draw the numbers, that the numbers could be drawn in a live format as well with an attendant entering data representing the selected numbers for resolution of the game.

Further the game can be played on a general purpose computer, on a gaming machine, and on linked computers or gaming machines connected to one another and/or to a server through a local area network ("LAN"), a wide area network ("WAN"), the Internet, or the like. In one application of such an optional embodiment, such as for Class II gaming jurisdictions, Bingo cards from other live linked players may replace the virtual cards.

DESCRIPTION

Figure 1:
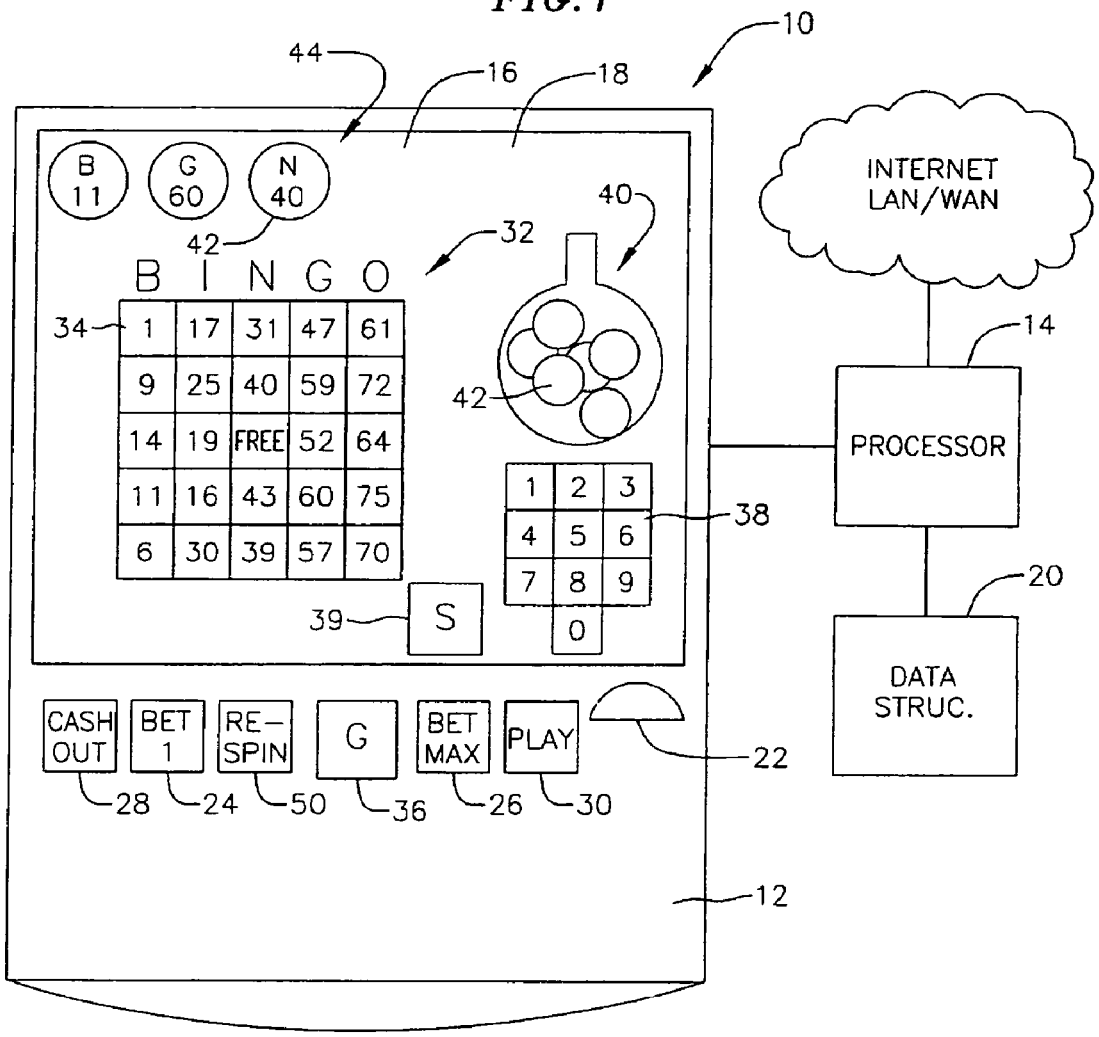
FIG. 1 is a block diagram of a device for play of the game including a display displays during the play of the game according to an optional embodiment.

Reference is now made to the figures wherein like parts are referred to by like numerals throughout. Turning to the drawings, FIG. 1 shows a device 10 for carrying out a method according to the present invention. The device includes a housing 12 to contain a processor 14 and the components as recited herein including a video display terminal or display 16. The display 16 may be a video terminal or plasma display and may include a touch screen 18 for the player to input selections as hereinafter described.

The processor 14 controls the various features of the device 10 including the display 16. A memory or data structure 20 is provided to store various program, operational and game play data as well as data corresponding to winning BINGO card patterns described below.

With continuing reference to FIG. 1, the device includes means for a player to make a wager. Where the device is operated as a Class II casino gaming device, these means may include a coin slot 22 at which the player inserts coins or tokens to make a wager, a cash validator to receive cash and accumulate credits for wagering in a known manner, a ticket receiver to receive vouchers, tickets, or other representations of cash or credit, or means to accept a wager via debit or credit card. Where the device 10 is a novelty game, the means for inputting a wager may include means for wagering fictitious credits or the like. For purposes of the following description, the device 10 is a gaming device of the type provided in casinos.

The waging input means may also include a Bet 1 button 24 by which, in a known manner, the player can wager a single unit or credit and a Bet Max button 26 by which the player may wager the maximum permitted by the device 10. Also provided is a cash out button 28 to enable the player to cash out the accumulated wagering credits from the play of the device 10 and a Play button 30 by which the player prompts the play of the device 10. It is noted that physical buttons would not necessarily be required and the various buttons described above may be embodied as locations on the touch screen 18 and display 16.

Figure 2:
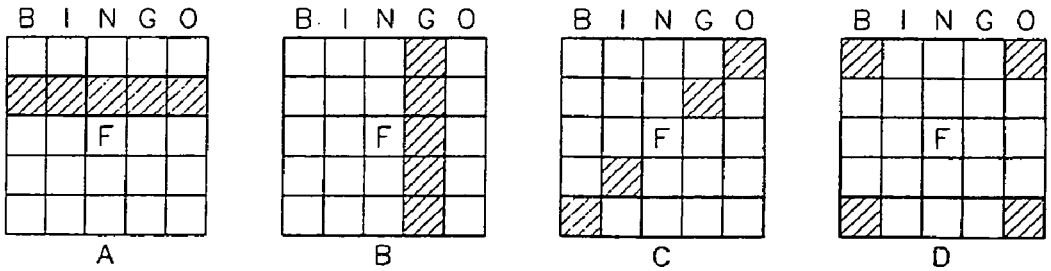
FIG. 2 is a front view of examples of winning patterns.
Figure 3:
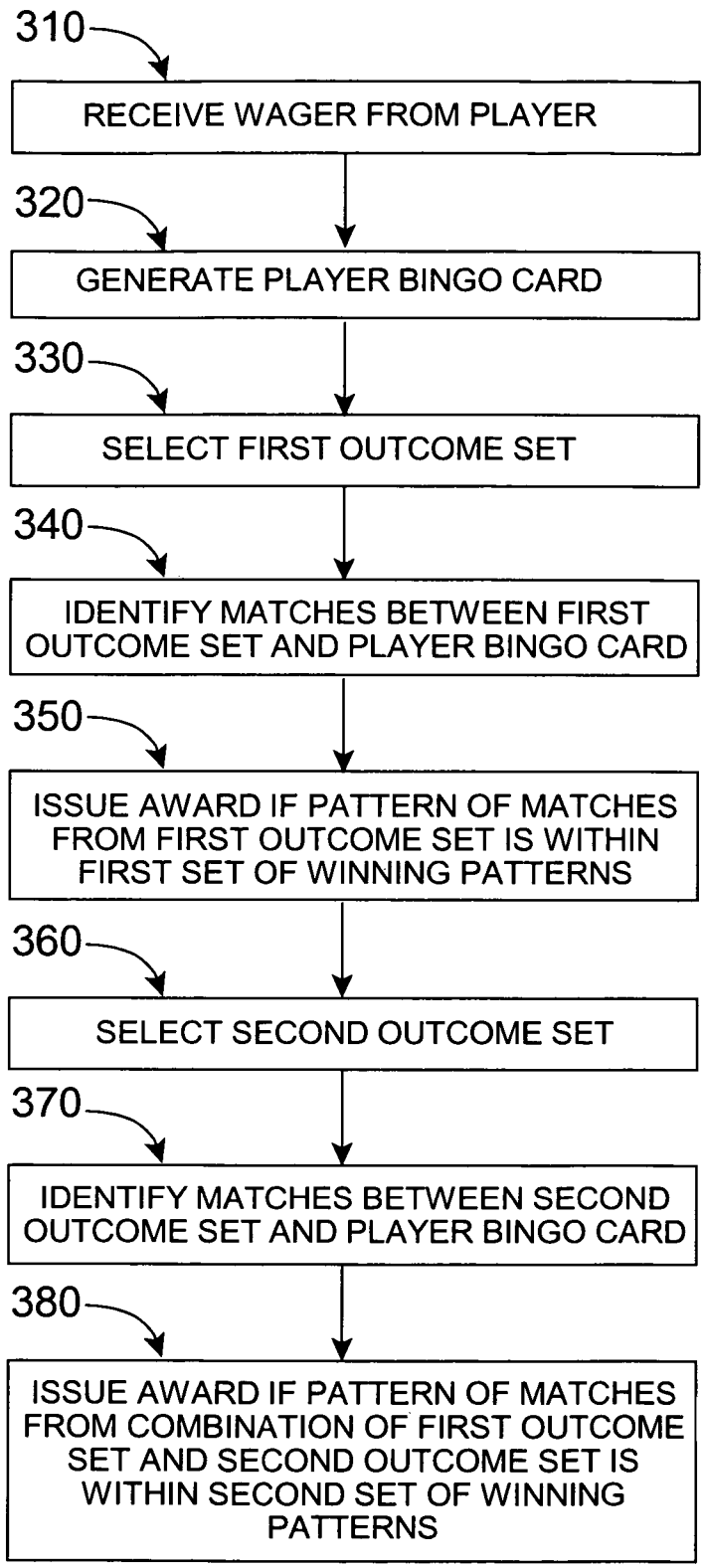
FIG. 3 is a flow chart of a method according to an optional embodiment of the present invention

Referring to FIGS. 1-3, in a gaming embodiment, the player initiates play by making a wager 310 by the wagering means. The wager can be one unit or credit up to a maximum amount permitted by the device 10. The wagering means communicates with the processor 14 to prompt the processor 14 to generate 320 at least one Bingo card and, optionally, control the display 16 to display at least one Bingo card 32. In a novelty embodiment, the player may not be required to place a wager, but rather would initiate play by directly prompting the generation of a Bingo card 32. Each card 32 is a matrix of coordinate locations, each including an indicia. In an optional embodiment, the card 32 is a conventional Bingo card having five columns and rows, with the columns identified by the letters B-I-N-G-O, however, it is contemplated that the card could take any form, shape, and/or size. When using a conventional 5×5 Bingo card, the card matrix defines twenty-five coordinate locations 34. At each coordinate location 34 there is provided a discrete indicium shown as a Bingo indicium. While the indicia used could take any form, in an embodiment based on conventional Bingo, the universe of Bingo indicia is one through seventy-five, inclusive, with one-fifth of numbers (1-15 for "B," 16-30 for "I," 31-45 for "N," 46-60 for "G," and 61-75 for "O") allocated to each column and one "Free" indicium allocated to the center coordinate location, i.e. the intersection of the third row and the third column.

Thus, in column B, each coordinate location 34 can be assigned a number selected from the group of numbers 1-15, for column I numbers 16-30, for column N numbers 31-45, except for the third coordinate location which may be assigned the "Free" indicium, for column G numbers 46-60, and for column O numbers 61-75. In conventional Bingo, the construction of the card restricts repetition of numbers on a card. When play is initiated, the processor 14 randomly assigns a number from the appropriate group to each coordinate location 34 such that no number appears twice on any card. When the center coordinate location of is allocated the "free" indicium, this coordinate location will always be marked for the game. It is noted that in an optional embodiment, a player may be allowed to play multiple Bingo cards, either at the player's option or with an additional fee or wager. In a further optional embodiment, the player may be required to add or subtract Bingo cards in blocks, such as ten Bingo cards at a time. In alternate embodiments, the player may be allowed to add or subtract Bingo cards from play singly.

In an optional embodiment, if the player wishes to play the card 32 with the processor assigned numbers, he/she prompts play by depressing the Play button 30. In the optional embodiment illustrated, if the player wishes the processor 14 to randomly select and position a different set of numbers on the card 32, the player depresses or touches on the touch screen 18 a "Generate" button. It is noted that this option for the selection and positioning of a different set of numbers on a Bingo card 32 is not limited to a game in which two or more outcome sets are selected. Rather the player option to regenerate a Bingo card could be offered in any game in which one or more outcome sets are selected. In such an optional embodiment, once the outcome set or sets are selected, any matches with the player's Bingo card 32 are noted and, optionally, marked. The player is rewarded if the matches form a winning pattern form a set of winning patterns.

In the optional embodiment illustrated, a player may select his/her own choice of numbers for each of the coordinate locations from the allocated group of numbers. These means may be a keypad 38 displayed on the display 16 at which the player, through the touch screen 18, selects the numbers. Thus the player can select the numbers for the card 32 or can have the processor 14 make the selection. To select their numbers, the player depresses a select button 39 on the device 10 or touch screen 18 and uses the key pad or other suitable input device to select the number for each coordinate location 34 as selected from the allocated groups of numbers for each column as described above. Such selection may be made for each player card, subject to the restriction that, within a single card, no number may be repeated.

Again, this feature is not limited to an embodiment in which two or more outcome sets are selected. Rather, the player may be enabled to select the indicia and/or position of indicia on the Bingo card. In such an optional embodiment, the player may be enabled to use a processor-generated Bingo card or opt to construct a card by inputting selections from the universe of indicia to determine the indicia included in the coordinates of the Bingo card. The player may additionally have control over the positions of the input selections on the Bingo card. Once the Bingo card is constructed, at least one outcome set is generated and any matches with the Bingo card are noted and, optionally, marked. If the matches form a winning pattern according to a set of winning patterns, the player is rewarded according to a corresponding pay table.

Once all cards 32 have been completely generated 320, play of the game continues with the selection 330 of a first outcome set. Optionally, the outcome set(s) are randomly selected by a random number generator ("RNG") communicating with, or integrated into, the processor 14 from the universe set of numbers of B 1-15, I 16-30, N 31-45, N 46-60 and O 61-75. Optionally, the processor 14 controls the display 16 to display the selection 330 of a first outcome set and, as described in greater detail below, the selection 360 of a second outcome set of numbers. The processor 14 may control the display 16 to display, during the selection as described above, a hopper or mixing cage 40 mixing balls 42 each bearing a letter/number combination and sequentially issuing a selected ball to be displayed at call board area 44 on the display 14.

The processor 14 controls the selection to select 330 a first outcome set of a pre-selected number of Bingo indicia. In an optional embodiment, the first outcome set includes twenty-five indicia 42. As each Bingo indicium is selected, the processor 14 compares 340 the selection to the Bingo indicia on each card 32. If a concordance occurs (i.e, the indicium drawn matches an indicium on the Bingo card) the processor 14 notes the match, and optionally controls the display 16 to indicate or mark that coordinate location 34 on that card. The marking may be indicated by flashing the coordinate location, displaying it in a different color, by superimposing a mark at the coordinate location 34, or by any other suitable means.

After the first outcome set has been selected, and comparisons and markings have been completed, the processor 14 compares the patterns of marked or indicated coordinate locations 34 corresponding to the prespecified first set of winning patterns of coordinate locations corresponding to the first outcome set stored in a data structure 20. If one or more winning patterns of marked coordinate locations 34 on any card 32 has been obtained, the player is entitled to a reward 350 based upon a first pay table. In an optional embodiment, the pay table determines awards based on the player's wager and the winning pattern obtained. With reference to FIG. 2, a group of pre-selected winning Bingo patterns is shown. Pattern A shows a row, pattern B shows a column, pattern C shows a diagonal and pattern D shows four corners.

If the pattern of marked coordinate locations 34 on a card 32 match one or more of the patterns of FIG. 2 based upon the selection of the first outcome set, the player is entitled to a reward. Table A sets forth an example of a pay table which may be provided for the game where the first outcome set includes twenty-five indicia and the player is using a conventional 5×5 Bingo card. It is to understood that other pay tables as well as patterns could be pre-selected and stored or selected by the player.

TABLE A

| | Wager | | | | |
|---|---|---|---|---|---|
| | 1 Unit | 2 Units | 3 Units | 5 Units | 10 Units |
| 1 Way | 10 | 20 | 30 | 50 | 50 |
| 2 Ways | 30 | 60 | 90 | 150 | 300 |
| 3 Ways | 100 | 200 | 300 | 500 | 1000 |
| 4 Ways | 300 | 600 | 900 | 1500 | 3000 |

For Table A, each "way" refers to a winning pattern such as a row, column, diagonal or four corner pattern obtained by the player. Thus if a player has one columns, two rows, and a diagonal marked after selection of the first outcome set, he would have a four way card and would receive an award based upon Table A.

After the processor 14 has determined any awards based upon the selection of the first outcome set, the processor randomly selects 360 a second outcome set of a pre-selected number of Bingo numbers (balls 42). In one embodiment, where the first outcome set contains twenty-five indicia, the second outcome set may contain ten indicia for a total selection of thirty-five indicia. In an alternate optional embodiment, the first outcome set may contain twenty-five indicia, and the second set of indicia may contain thirty-one indicia.

As with the first outcome set, as the second outcome set is selected, the processor 14 compares 370 each selected indicium with the indicia at the coordinate locations on each Bingo card 32. If a selected indicium matches the indicium at a card coordinate location, the match is noted and, optionally, that coordinate location 34 is marked. Further the balls 42 selected may be displayed in the call board area 44 and may optionally be displayed in a different color in the call board area 44 and at the card coordinate locations 34 to distinguish indicia selected in the first outcome set from indicia selected in the second outcome set. When the selection has been completed, the processor 14 determines whether any of the cards 32 has a marked pattern matching a pattern according to a second set of winning patterns. In this regard, it is noted that the second set of winning patterns are compared to the patterns formed by the matches from the combination of the first and second outcome sets. In other words, if the pattern from the second outcome set is a cover all, and the first outcome set results in matches on ten of the coordinates, the player will have a cover all if the second outcome set results in matches on the remaining fourteen coordinates (assuming that one coordinate has a "Free" indicium) because the first and second outcome sets, combined, resulted in a pattern from the second set of winning patterns.

If the player matches a pattern from the second set of winning patterns, the player is entitled 380 to a second award based on a second pay table. As noted above, in one example, a winning pattern requires a cover all, meaning all twenty-five coordinate locations on a single card, must be marked. If a player obtains a cover all from the first outcome set alone or with the additional draws of the second outcome set, the player would receive an award for the cover all. Optionally, the award is based on the player's initial wager, although in one optional embodiment, the award may be based on the initial wager plus a supplemental wager. Table B illustrates one optional embodiment in which the total draws (i.e. the sum of quantity of draws in the first outcome set and second outcome set) is fifty-six indicia, and the second set of winning patterns includes a cover all, although it is to be understood that other pay tables could be adopted as well.

TABLE B

| | Wager | | | | |
|---|---|---|---|---|---|
| | 1 Unit | 2 Units | 3 Units | 5 Units | 10 Units |
| Cover All | 500 | 1000 | 1500 | 2500 | 5000 |

In an optional embodiment, to provide for a progressive second award, a portion of each wager, e.g. such as 2½ percent, may be allocated to a progressive jackpot. With reference to FIG. 1, to provide even larger jackpots, a plurality of like devices 10 may have their processors 14 linked through an Internet, LAN (local area network) or WAN (wide area network) whereupon a portion of the wagers from all linked machines are allocated to a mutual jackpot to be awarded upon the player obtaining a qualifying marked pattern, such as a cover all. This progressive may, based upon the odds of obtaining a marked pattern such as a cover all, start at 50,000 units.

It should be appreciated that additional outcome sets, with additional sets of winning patterns and associated additional pay tables could be used. In other words, a game according to the present method could be staged, in which a group of indicia are drawn, the player's Bingo card is evaluated for matches, and awards are noted, then another stage is conducted, until some predetermined ending event, such as the drawing of a predetermined quantity of indicia, a player win, expiration of a time period, or the like. For example, in one optional embodiment, a first outcome set includes twenty-five indicia, a second outcome set includes five indicia, a third outcome set includes five indicia, a fourth outcome set includes five indicia, and a fifth outcome set includes five indicia, for a total of forty-five indicia drawn. With each outcome set, the Bingo card is reevaluated according to the set of winning patterns corresponding to the outcome set drawn and any awards are determined by the corresponding pay table.

In the optional embodiment illustrated, the player may have the option to play another game using the same Bingo card or set of Bingo cards 32. To opt for the same Bingo card or cards, the player enters another wager and prompts play.

However, in an optional embodiment, the player may have the option to select a different set of cards 32, such as by prompting the re-generation of the Bingo cards to reselect the indicia displayed on the Bingo card or, in an additional or alternate embodiment, by opting to select the indicia and/or location of indicia to generate a personalized Bingo card. In an alternate optional embodiment, the player may elect to keep or replace Bingo cards individually, or in groups.

In an optional embodiment in which actual currency is used, to cash out or receive a pay, the player depresses the cash out button 28 and coins or tokens are dispensed. In alternate embodiments, any award may be credited to a local or remote account, dispensed as a voucher or ticket representing the award, or simply tracked, as in a novelty embodiment used strictly for entertainment rather than gambling.

In an optional embodiment, the first outcome set and second outcome set are selected using a random number generator ("RNG") that uses a selected seed to generate a stream of random numbers. In such an optional embodiment, the player may be enabled to, prior to commencement of any game, prompt re-selection of the seed. By such alteration, the player randomly affects all subsequent random selection of indicia. Thus, a player who has played a set of cards 32 a plurality of times without success, may feel that the RNG is not timed so as to select a winning outcome and that another RNG seed may result in the random selection of a winning outcome. For example, in one optional embodiment, an RNG based on a clock may be used to generate the draws. In such an optional embodiment, a player may alter the clock setting or such other seed data as is used by the RNG by pressing a "Re-spin" button 50. Upon a player's pressing the Re-spin button 50 before the start of a game, the processor would either advance or retard the RNG clock and alter the input to the RNG selection process. This may, lead the player to believe that the player has improved the player's chance of obtaining a winning outcome.

The feature allowing a player to re-seed an RNG is not limited to a game in which at least two outcome sets are generated. Rather, the feature may be applied to any game in which one or more outcome sets are generated. In such an optional embodiment, a player may opt, before any outcome set or sets are generated, to re-select the seed for the RNG used to generate that outcome set or those outcome sets. Using the one or more outcome sets generated, matches with the Bingo card or cards are noted and, optionally, marked. If the matches form a winning pattern from a set of winning patterns, the player is issued an award based on an associated pay table.

To alter the performance of the game, the number of indicia 42 drawn for the first and/or second outcome set may be altered. For example, in another embodiment the first outcome set may be twenty-five indicia 42 with the second outcome set being an additional thirty-one indicia 42 for totals of fifty-six indicia 42. In this embodiment the reward associated with the achievement of a cover all from the total draw might provide of 400 times the amount wagered.

In one optional embodiment, a player places a first wager prior to the selection of any outcome sets. In such an optional embodiment, awards are based on the first wager, such as being a multiple of the first wager. In an alternate optional embodiment, the player may be afforded the option to place a second wager prior to the selection of the second outcome set. For example, the player may make a first wager of five units and after the first draw of, for example, twenty-five indicia 42 have obtained a two-way outcome yielding an award of one hundred units according to an optional pay table. The player may then make a second wager before prompting play whereupon the second set of, for example, ten indicia 42 is drawn. In one optional embodiment, there may be certain restrictions on the conditions where a player may place a second wager. For example, in one optional embodiment, the size of the second wager must match the first wager and the player must have a predetermined minimum outcome (such as at least a three-way win after the first outcome set is drawn). In such an example, the award from the second pay table may be doubled if the second wager is placed. It should be noted that other awards based on the second wager and the draw of the first and second outcome sets could be adopted as well. It should be understood that the second wager could be double the first wager, or less than or more than the first wager.

In one optional embodiment, the player can make a second wager, e.g. match or otherwise supplement the first wager, and receive an award even in circumstances where the player has a winner from the first outcome set, and his result does not improve. For example, if the player makes a five unit wager and has a three-way result from the first outcome set, he may double his wager, and even if the player does not improve the card by obtaining a higher pay outcome (i.e. still only has a three-way after the first and second outcome sets have been drawn), the player may still receive a double award.

In another embodiment, the player receives an award based upon the second wager only if the outcome is improved by the draw of the second outcome set. Thus, in the example above where the second outcome set does not result in improvement upon the three-way obtained from the first outcome set, the player's second wager would be lost and the player would be paid only the reward he would have been entitled to under the first pay table. Conversely, in such an embodiment, if the outcome was improved based upon the draw of the second outcome set the player would be paid based on the combined (i.e. first and second) wager.

Other methods for awarding the player based upon the first and second outcome sets can be considered as well. For example, if the second outcome set improves the pattern on the Bingo card, the player would be paid an award based on the first pay table and the first wager and an award based on the second pay table on the combined wager.

In yet another optional embodiment, the second wager may be received at a point in the game dictated by the pattern on the player's Bingo card. For example, in one optional embodiment, when the player obtains a partial pattern, such as one indicia short of a cover all (i.e. twenty-four, including the free space, of the twenty-five indicia needed), play may temporarily suspend and the player may be allowed to place a second wager. Should the player ultimately obtain the pattern from the set of winning patterns, the player would be rewarded based on the first wager and second wager.

Referring generally to the present device and method of play, the player is provided with several opportunities to win. The player may obtain one or more winning patterns from the first outcome set or the player may obtain a qualifying pattern upon selection of the second outcome set. Further the method and device permits a single player to play Bingo The player can also select the numbers for their cards 32 and can alter the seed for the RNG.

While the above describes the device and method in which a player is competing against a pay table, such as at a gaming device, it should be understood that the game can be played against one or more virtual or live players, such as with linked terminals connected through, for example, a local area network, ("LAN"), wide area network ("WAN"), through the Internet, or the like.

In one such optional embodiment, the processor 14 would be located remote from and in communication with player terminals. Players would wager upon and enable one or more Bingo cards 32 for play. The numbers for the Bingo card(s) may be selected by the processor 32 or by the remote and linked player in the manner described above. The first and second outcome sets could be drawn using a central server, by using a physical Bingo ball cage, or in some other centralized manner, with the drawing broadcast to the player terminals. The processor would compare the first and second outcome sets to the numbers on player Bingo cards and announce/display winners and awards. The awards to players for winning card(s) may be cached at a player account with the casino or issued to the player by known means.

In an alternate optional Class II embodiment, with a single player playing a device 10 and to assure compliance with the requirement of having a winning card for each game, the processor 14 is configured to establish for each game a plurality of casino cards stored in the memory of the processor 14. The player competes with his cards against these casino cards. To assure a winning card from the selection of the first and second outcome sets, a sufficient quantity, such as one hundred or more, casino cards can be created by the processor 14 for each game.

In such an optional embodiment, the player makes a first wager and plays one or more player Bingo-card. The processor 14 enables a plurality of virtual cards, e.g. sufficient cards for the total number of player and casino cards so that the pool of cards will, statistically, be expected to produce at least one winning pattern. Since the processor 14 randomly picks the numbers for the coordinate locations of the virtual cards, each card should be different. Optionally, the selection process may ensure that no two cards have the same numbers selected for the same coordinate locations. Statistically, from a pool of substantially one hundred cards, there should be at least one card with a pattern qualifying for an award from at least the first outcome set.

The processor 14 (or though a live draw) initially selects the first outcome set. If the player card has a winning outcome from the first set of winning outcomes based on matches with the first outcome set, that player is issued an award from a first pay table. The processor 14 (or through a live draw) then selects the second outcome set. Following selection of the second outcome set, the accumulation of matches on the player and virtual Bingo cards from the first outcome set in combination with the second outcome set are determined. If no player card has a winning outcome for the first and second outcome sets, e.g. a cover all from the combined sets as described above, the virtual cards are examined.

If any virtual card has a winning outcome from the second set of winning outcomes based on matches with the combination of the first and second outcome sets, the game ends and no additional award is issued. Such winning outcomes occurring in the virtual cards may be displayed for the player to see to confirm that there has been at least one winning outcome from the draw of the first and second outcome sets. In one optional embodiment, if no casino card has such a winning outcome, the players wager(s) may be returned, i.e. as in a draw. In an alternate optional embodiment, if no player or casino Bingo card has a winning outcome from the draw of the first and second outcome sets, additional indicia may be selected until at least one winning result occurs. If the winning result is on a player Bingo card, a reward will be issued according to a prespecified pay table; if the winning result is on a casino card, the game ends and no additional award is issued; if a player card and a casino card simultaneously produce winning results, a tie resolution may determine the result. Optionally such a result may be a push, a player win, or a player loss. In yet another optional embodiment, if no player or casino Bingo card has a winning outcome from the draw of the first and second outcome sets, the player's wager(s) are returned to the player or the player is issued a reward.

In this embodiment, the player may also have the option of placing a second wager after the selection of the first outcome set, but before the selection of the second outcome set, with the effect as described above.

While certain embodiments of the present invention have been shown and described it is to be understood that the present invention is subject to many modifications and changes without departing from the spirit and scope of the claims presented herein.

I claim:

1. A method for conducting a Bingo game at a device including a display, an input device, and memory in communication with a data processor, the method comprising:

said data processor defining at least one Bingo card having a matrix of coordinates, each coordinate displaying an indicium selected from a universe of predefined indicia, wherein said step of defining said Bingo card includes receiving selections through said input device by said player of at least one indicium from said universe of indicia and displaying the at least one indicium selected by said player in the coordinates of said Bingo card at said display;

storing at said memory a first set of winning patterns of identified coordinates on said Bingo card and a second set of winning patterns of identified coordinates on said Bingo card, wherein said second set is different from said first set;

storing at said memory a first pay table indicating awards corresponding to said first set of winning patterns and a second pay table indicating awards corresponding to said second set of winning patterns;

said data processor selecting a first outcome set of fixed, predetermined size from the universe of indicia;

said data processor selecting a second outcome set of fixed, predetermined size from the universe of indicia depleted of the first outcome set;

said data processor comparing said first outcome set to the indicia displayed on said Bingo card;

said data processor issuing an award based on said first pay table if the pattern formed by the indicia displayed on said Bingo card matching said first outcome set is a winning pattern according to said first set of winning patterns;

said data processor comparing the combination of said first outcome set and said second outcome set to the indicia displayed on said Bingo card;

said data processor issuing an award based on said second pay table if the pattern formed by the indicia displayed on said Bingo card matching the combination of said first outcome set and said second outcome set is a winning pattern according to said second set of winning patterns; and said data processor replenishing said depleted universe of indicia by restoring said first outcome set and second outcome set to said universe of indicia for selection in a subsequent outcome set in the same or subsequent game.

2. The method of claim 1 wherein said first set of winning patterns includes one or more of the patterns selected from the columns, rows, diagonals, four corners, and cover all of said Bingo card and second set of winning patterns includes one or more of the patterns selected from the columns, rows, diagonals, four corners, and cover all of said Bingo card, wherein said second set includes at least one pattern excluded from said first set.

3. The method of claim 1 wherein said first outcome set comprises twenty-five indicia.

4. The method of claim 1 wherein said second outcome set comprises at least ten indicia.

5. The method of claim 1 wherein the universe of indicia includes the numbers one through seventy-five, inclusive.

6. The method of claim 1 wherein at least one coordinate of said Bingo card includes a free indicia that is considered a match in any pattern including said free indicia.

7. The method of claim 1 further comprising said data processor receiving from said player through said input device a first wager prior to the selection of said first outcome set or said second outcome set, wherein said awards are multiples of said first wager.

8. The method of claim 7 further comprising said data processor receiving from said player a second wager at least after said selection of said first outcome set but prior to said selection of said second outcome set.

9. The method of claim 8 wherein awards issued according to said first pay table are multiples of said first wager and awards issued according to said second pay table are multiples of the sum of said first wager and said second wager.

10. The method of claim 9 wherein said first set of winning patterns excludes a coverall, said second set of winning patterns includes a cover all.

11. The method of claim 1 wherein said second set of winning patterns includes any combination of three column, row, diagonal, and four corner patterns, any combination of four column, row, diagonal, and four corner patterns, and a cover all pattern.

12. The method of claim 1 further comprising said data processor displaying at said display each indicium of said first outcome set and said second outcome set.

13. The method of claim 12 wherein said indicia of said first outcome set are displayed at said display in a first color and said indicia of said second outcome set are displayed in a second color different from said first color.

14. The method of claim 7 wherein said first pay table includes awards based upon the quantity of winning patterns obtained and the size of said first wager.

15. The method of claim 14 wherein said first set of winning patterns includes the rows, columns, and diagonals of said Bingo card and excludes a coverall of said Bingo card, said second set of winning patterns includes a cover all of said Bingo card.

16. The method of claim 1 wherein at least one of said first outcome set and said second outcome set are randomly selected by said data processor utilizing a random number generator using a selected seed, said method further comprising said data processor prompting said player to elect whether to re-select said seed and receiving from said player an election to re-select said seed in response to said prompt, wherein if an election to re-select said seed is received from said player, said seed for said random number generator is re-selected by said data processor.

17. The method of claim 1 wherein said second set of winning patterns excludes at least one pattern included in said first set.

18. A method for conducting a Bingo game at a device including a display, an input device, and memory in communication with a data processor, the method comprising:

said data processor defining at least one Bingo card having a matrix of coordinates, each coordinate displaying an indicium selected from a universe of predefined indicia, and displaying said at least one Bingo card at said display;

storing at said memory a first set of winning patterns of identified coordinates on said Bingo card and a second set of winning patterns of identified coordinates on said Bingo card, wherein said first set of winning patterns and second set of winning patterns are selected from one or more of the columns, rows, diagonals, four corners, or cover all of said Bingo card and wherein said second set is different from said first set;

storing at said memory a first pay table indicating awards corresponding to said first set of winning patterns and a second pay table indicating awards corresponding to said second set of winning patterns;

said data processor selecting a first outcome set of fixed, predetermined size from the universe of indicia;

said data processor selecting a second outcome set of fixed, predetermined size from the universe of indicia depleted of the first outcome set;

said data processor comparing said first outcome set to the indicia displayed on said Bingo card;

said data processor issuing an award based on said first pay table if the pattern formed by the indicia displayed on said Bingo card matching said first outcome set is a winning pattern according to said first set of winning patterns;

said data processor comparing the combination of said first outcome set and said second outcome set to the indicia displayed on said Bingo card;

said data processor issuing an award based on said second pay table if the pattern formed by the indicia displayed on said Bingo card matching the combination of said first outcome set and said second outcome set is a winning pattern according to said second set of winning patterns;

said data processor conducting at least one additional Bingo game wherein said step of defining at least one Bingo card in said additional Bingo game further comprises said data processor receiving from said player through said input device an option to use a Bingo card defined in a preceding game or an option to regenerate said Bingo card, wherein if the player opts to regenerate said Bingo card, said indicia displayed in said matrix of coordinates are re-selected and the re-selected indicia replace the indicia displayed in said matrix of coordinates; and prior to conducting said at least one additional Bingo game, said data processor replenishing said depleted universe of indicia by restoring said first outcome set and second outcome set to said universe of indicia for selection in a subsequent outcome set in said at least one additional game.

19. The method of claim 18 wherein said first outcome set comprises twenty-five indicia and said second outcome set comprises thirty-one indicia.

20. The method of claim 19 wherein said first outcome set comprises twenty-five indicia, said second outcome set comprises thirty-one indicia, and said second set of winning patterns only includes a cover all.

21. The method of claim 18 wherein the universe of indicia includes the numbers one through seventy-five, inclusive.

22. The method of claim 18 further comprising:

storing at said memory at least one additional set of winning patterns of identified coordinates on said Bingo card;

storing at said memory at least one additional pay table indicating awards corresponding to at least one additional set of winning patterns;

said data processor selecting at least one additional outcome set from the universe of indicia depleted of the first outcome set and the second outcome set; and said data processor comparing the combination of said first outcome set and said second outcome set and at least one additional outcome set to the indicia displayed on said Bingo card; and said data processor issuing an award based on said second pay table if the pattern formed by the indicia displayed on said Bingo card matching the accumulation of said first outcome set, said second outcome set, and at least one additional outcome set is a winning pattern according to said additional set of winning patterns.

23. The method of claim 18 wherein at least one coordinate of said Bingo card includes a free indicia that is considered a match in any pattern including said free indicia.

24. The method of claim 18 further comprising said data processor receiving a first wager from said player through said input device prior to the selection of said first outcome set or said second outcome set, wherein said awards are multiples of said first wager.

25. The method of claim 24 further comprising said data processor receiving a second wager from said player through said input device at least after said selection of said first outcome set but prior to said selection of said second outcome set.

26. The method of claim 25 wherein awards issued by said data processor according to said first pay table are multiples of said first wager and awards issued according to said second pay table are multiples of the sum of said first wager and said second wager.

27. The method of claim 18 wherein said second set of winning patterns includes any combination of three column, row, diagonal, and four corner patterns, any combination of four column, row, diagonal, and four corner patterns, and a cover all pattern.

28. The method of claim 18 further comprising said data processor displaying at said display each indicium of said first outcome set and said second outcome set.

29. The method of claim 28 wherein said indicia of said first outcome set are displayed in a first color and said indicia of said second outcome set are displayed in a second color different from said first color.

30. The method of claim 18 wherein said step of defining said Bingo card includes said data processor receiving selections through said input device by said player of at least one indicium from said universe of indicia and displaying the at least one indicium selected by said player in the coordinates of said Bingo card.

31. The method of claim 18 wherein said first pay table includes awards based upon the quantity of winning patterns obtained and the size of said first wager.

32. The method of claim 18 wherein at least one of said first outcome set and said second outcome set are randomly selected by said data processor utilizing a random number generator using a selected seed, said method further comprising said data processor prompting said player to elect whether to re-select said seed and receiving from said player through said input device an election to re-select said seed in response to said prompt, wherein if an election to re-select said seed is received from said player, said seed for said random number generator is re-selected by said data processor.

33. The method of claim 18 wherein said second set of winning patterns includes at least one pattern excluded from said first set.

34. The method of claim 18 wherein said second set of winning patterns excludes at least one pattern included in said first set.

35. A device for conducting a Bingo game comprising:

a data processor;

a display in communication with said data processor;

an input device in communication with said data processor; and memory in communication with said data processor, said memory storing program instructions executable by said data processor to conduct a method comprising:

said data processor defining at least one Bingo card having a matrix of coordinates, each coordinate displaying an indicium selected from a universe of predefined indicia, and displaying said Bingo card at said display;

storing at said memory a first set of winning patterns of identified coordinates on said Bingo card and a second set of winning patterns of identified coordinates on said Bingo card, wherein said second set is different from said first set;

storing at said memory a first pay table indicating awards corresponding to said first set of winning patterns and a second pay table indicating awards corresponding to said second set of winning patterns;

said data processor receiving a wager from said player through said input device;

said data processor selecting a first outcome set of fixed, predetermined size from the universe of indicia;

said data processor selecting a second outcome set of fixed, predetermined size from the universe of indicia depleted of the first outcome set;

said data processor comparing said first outcome set to the indicia displayed on said Bingo card;

said data processor issuing an award based on said first pay table if the pattern formed by the indicia displayed on said Bingo card matching said first outcome set is a winning pattern according to said first set of winning patterns;

said data processor comparing the combination of said first outcome set and said second outcome set to the indicia displayed on said Bingo card;

said data processor issuing an award based on said second pay table if the pattern formed by the indicia displayed on said Bingo card matching the combination of said first outcome set and said second outcome set is a winning pattern according to said second set of winning patterns; and said data processor replenishing said depleted universe of indicia by restoring said first outcome set and second outcome set to said universe of indicia for selection in a subsequent outcome set in the same or subsequent game.

36. A device for conducting a Bingo game comprising:

a data processor;

a display in communication with said data processor;

an input device in communication with said data processor; and memory in communication with said data processor, said memory storing program instructions executable by said data processor to conduct a method comprising:

said data processor defining at least one Bingo card having a matrix of coordinates, each coordinate displaying an indicium selected from a universe of predefined indicia, wherein said step of defining said Bingo card includes receiving selections through said input device by said player of at least one indicium from said universe of indicia and displaying the at least one indicium selected by said player in the coordinates of said Bingo card at said display;

storing at said memory a first set of winning patterns of identified coordinates on said Bingo card and a second set of winning patterns of identified coordinates on said Bingo card, wherein said second set is different from said first set;

storing at said memory a first pay table indicating awards corresponding to said first set of winning patterns and a second pay table indicating awards corresponding to said second set of winning patterns;

said data processor receiving a wager from said player through said input device;

said data processor selecting a first outcome set of fixed, predetermined size from the universe of indicia;

said data processor selecting a second outcome set of fixed, predetermined size from the universe of indicia depleted of the first outcome set;

said data processor comparing said first outcome set to the indicia displayed on said Bingo card;

said data processor issuing an award based on said first pay table if the pattern formed by the indicia displayed on said Bingo card matching said first outcome set is a winning pattern according to said first set of winning patterns;

said data processor comparing the combination of said first outcome set and said second outcome set to the indicia displayed on said Bingo card;

said data processor issuing an award based on said second pay table if the pattern formed by the indicia displayed on said Bingo card matching the combination of said first outcome set and said second outcome set is a winning pattern according to said second set of winning patterns; and said data processor replenishing said depleted universe of indicia by restoring said first outcome set and second outcome set to said universe of indicia for selection in a subsequent outcome set in the same or subsequent game.

37. A device for conducting a Bingo game comprising:

a data processor;

a display in communication with said data processor;

an input device in communication with said data processor; and memory in communication with said data processor, said memory storing program instructions executable by said data processor to conduct a method comprising:

said data processor defining at least one Bingo card having a matrix of coordinates, each coordinate displaying an indicium selected from a universe of predefined indicia, and displaying said at least one Bingo card at said display;

storing at said memory a first set of winning patterns of identified coordinates on said Bingo card and a second set of winning patterns of identified coordinates on said Bingo card, wherein said second set is different from said first set;

storing at said memory a first pay table indicating awards corresponding to said first set of winning patterns and a second pay table indicating awards corresponding to said second set of winning patterns;

said data processor receiving a wager from said player through said input device;

said data processor selecting a first outcome set of fixed, predetermined size from the universe of indicia;

said data processor selecting a second outcome set of fixed, predetermined size from the universe of indicia depleted of the first outcome set;

said data processor comparing said first outcome set to the indicia displayed on said Bingo card;

said data processor issuing an award based on said first pay table if the pattern formed by the indicia displayed on said Bingo card matching said first outcome set is a winning pattern according to said first set of winning patterns;

said data processor comparing the combination of said first outcome set and said second outcome set to the indicia displayed on said Bingo card;

said data processor issuing an award based on said second pay table if the pattern formed by the indicia displayed on said Bingo card matching the combination of said first outcome set and said second outcome set is a winning pattern according to said second set of winning patterns;

said data processor conducting at least one additional Bingo game wherein said step of defining at least one Bingo card in said additional Bingo game further comprises said data processor receiving from said player through said input device an option to use a Bingo card defined in a preceding game or an option to regenerate said Bingo card, wherein if the player opts to regenerate said Bingo card, said indicia displayed in said matrix of coordinates are re-selected and the re-selected indicia replace the indicia displayed in said matrix of coordinates; and prior to conducting said at least one additional Bingo game, said data processor replenishing said depleted universe of indicia by restoring said first outcome set and second outcome set to said universe of indicia for selection in a subsequent outcome set in said at least one additional game.

* * * * *